US005456300A

United States Patent [19]

Rosenkranz et al.

[11] Patent Number: 5,456,300

[45] Date of Patent: Oct. 10, 1995

[54] CUTTER BLOCK AND KNIFE FOR A CUTTER SPINDLE CHIPPER

[75] Inventors: Gerhard Rosenkranz, Perchtoldsdorf; Erwin Zeitlhofer, Bohlerwerk; Dieter Doberl, Bohlerwerk; Friedrich Berger, Bohlerwerk, all of Austria

[73] Assignee: Böhler Ybbstalwerke G.M.B.H., Böhlerwerk, Austria

[21] Appl. No.: 216,286

[22] Filed: Mar. 23, 1994

[30] Foreign Application Priority Data

Mar. 23, 1993 [AT] Austria ..... 580/93

[51] Int. Cl.[6] ..... B27G 13/04

[52] U.S. Cl. ..... 144/230; 144/174; 144/241; 241/292.1; 241/294; 407/46; 407/48

[58] Field of Search ..... 144/162 R, 172, 144/174, 176, 218, 230, 241; 407/46, 48; 241/292.1, 293, 294, 295; 83/698

[56] References Cited

U.S. PATENT DOCUMENTS

| | | | |
|---|---|---|---|
| 3,854,511 | 12/1974 | Maier | 144/230 |
| 3,957,094 | 5/1976 | Maier | 144/230 |
| 3,989,077 | 11/1976 | Humbert | 144/230 |
| 4,470,442 | 9/1984 | Krautzberger et al. | 144/230 |
| 4,544,009 | 10/1985 | Kröcher | 144/230 |
| 4,658,875 | 4/1987 | Grobovac | 144/230 |
| 5,305,811 | 4/1994 | Schaefer | 144/230 |

FOREIGN PATENT DOCUMENTS

| | | |
|---|---|---|
| 240032 | 5/1965 | Austria . |
| 356362 | 4/1980 | Austria . |
| 358808 | 10/1980 | Austria . |
| 368932 | 11/1982 | Austria . |
| 0085040 | 8/1983 | European Pat. Off. . |
| 0125371 | 11/1984 | European Pat. Off. . |
| 1195934 | 7/1965 | Germany . |
| 2159033 | 6/1973 | Germany . |
| 2208687 | 6/1973 | Germany . |
| 2523579 | 12/1976 | Germany . |
| 3039833 | 5/1982 | Germany . |
| 3517539 | 11/1986 | Germany . |

*Primary Examiner*—W. Donald Bray
*Attorney, Agent, or Firm*—Sandler, Greenblum & Bernstein

[57] ABSTRACT

The invention relates to a cutter block and a knife for chippers for removing particles of wood, which are used for producing particle board and the like. The knife is embodied as a disposable discontinuous or multiple edge knife or as a solid blade knife. The knife has retention and guiding recesses engaged form-fittingly by positioning pins of a support plate. Further, the knife is in compressive contact with a side wall face, trailing in the direction of rotation of the cutter block of the recess in the surface region of the block body.

26 Claims, 2 Drawing Sheets

CUTTER BLOCK AND KNIFE FOR A CUTTER SPINDLE CHIPPER

BACKGROUND OF THE INVENTION

1. Field of the Invention

The present invention relates to a cutter block in drum-disk or annular form for chipping equipment for removing generally flat and/or relatively long particles of grown wood for producing excelsior, preliminary material for particle board, and the like, essentially including a block body having at least one longitudinally straight or helical recess in the surface region; in this recess, a part connected to a knife is guided by retaining means in a manner protected against radial displacement, and the part can be pressed by a centrifugal wedge or chuck against a side wall of the recess.

The invention also relates to a discontinuous or plural edge knife or solid blade knife for cutter spindle chippers for removing generally flat and/or relatively long particles of grown wood for producing excelsior, preliminary material for particle board and the like, essentially including a base body and, leaving intermediate regions with end faces free in the longitudinal direction, cutting regions protruding laterally from these end faces and having cutting edges.

2. Description of Background and Material Information

In the production of particle board (also called wood fiber board), generally flat and/or elongated particles or chips of wood are joined together using adhesives such as resins, glues and the like. This joining is made or initiated between spaced-apart, optionally moving pressure faces under pressure. To obtain the particles, wood is chipped or chips of slight thickness are removed from the wood and subjected to further processing. The chipping or removal is done with cutter blocks, which have knives with optionally discontinuous blades in the region of their surface. Such knives or chipping knives are made of knife steel or tool steel that suitably holds an edge, typically having a thickness of 5 millimeters (mm) or more and being able to be resharpened many times by grinding down the beveled face. FIG. 1 illustrates the known prior art.

For the purpose of resharpening the knife edge, as shown in FIG. 1, the knife 5 can be readjusted radially of the cutter block 1 and fixed to a guide part 4 by connecting means, such as cap screws 41, in the slit region. The greatest possible knife thickness is chosen, on the one hand, to achieve stable anchoring of the blade part by means of at least five thread courses, for instance and, on the other hand, to keep vibration of the blade during chip removal as slight as possible, so that chip breakage and hence the generation of undesired fines will be minimized.

In this kind of cutter block for chipping, having a multiple edge (or discontinuous blade) knife or solid blade knife embodiment in which the thickness of the blade part is significant, re-grinding to form a sharp knife edge can be done many times, and only slight amounts of fines are produced in the removal of the wood. Nevertheless, the precise radial adjustment of the knife in the block body so as to be secure during operation, and the production of the blade part itself, are costly in time and money and require long chipper set-up times, as well as involving expense for procurement and warehousing.

SUMMARY OF THE INVENTION

An object of the present invention is to avoid the disadvantages of the prior art. More particularly, it is an object of the invention to overcome the disadvantages of the known cutter blocks and discontinuous edge or solid blade knives and to furnish new components that have improved blade parts for chippers for removing particles from grown wood.

In an apparatus of the general type involved here, the aforementioned object is attained in that the knife is embodied as a disposable discontinuous edge or solid blade knife, optionally insertable from either of two sides, and has retaining and guide recesses which are engaged form-fittingly by positioning pins or positioning elements of a support plate on which the knife rests. The support plate, which in turn is connected directly, or in combination with or via a guide part disconnectably, to the block body, secured against radial displacement, in such a way that the knife is positionable on the trailing side wall face of the recess, in terms of the direction of rotation of the cutter block. This side wall face has at least one rectilinear generatrix and the knife can be pressed over a large area against this side wall face by the centrifugal wedge or chuck, which is positionable by means of a clamping element.

The advantages attained by the invention are considered essentially to be that the knife or knives can be embodied as thin, disposable knives and can be inserted into the cutter block simply and in an accurate position relative to the axis of rotation of the cutter block. As a result, the setup times of the chipper can be kept short, which makes for great economy. In comparison with conventional cutter blocks, accurate adjustment work after sharpening of the blade parts can be dispensed with, and no expensive grinding devices whatever are needed, either. Still greater economy is achieved if the knives can be inserted from both ends by grinding on both sides, thus reducing consumption of parts and lowering and inventory expenses. Counter to the prejudice of those in the art, such knives can be adjusted accurately and secured stably on a support plate against radial displacement from centrifugal forces by retention and guide recesses engaged by positioning pins of the support plate, only if a large-area pressing of the blade part against the side wall of the recess of the block body, brought about by a centrifugal wedge or chuck, takes place. The surface of the side wall must have at least one rectilinear generatrix for that purpose.

Preferably, the knife has a thickness of from 0.5 to 4 mm, preferably from 1.0 to 2.5 mm, and, guided by positioning pins, is located preferably in a recess of the support plate that corresponds to the thickness of the knife with an undersize, and the support plate, secured against radial displacement by a retaining means, is in compressive contact, in the cross-sectional region opposite the retaining means, on the one hand with an inclined face of the centrifugal wedge and on the other with one of the plane-parallel side faces of the knife, which is supported over a large area by its opposite side face on the side wall of the recess that trails after in the direction of rotation of the cutter block.

Completely surprisingly, it has been found that even lightweight, thin knives remain largely vibration-free and bring about removal of wood in the desired form, if accurate axial guidance is present and in particular if there is large-area support with compressive contact on the knife or side wall face. It has proved to be especially advantageous if the knife is disposed in a recess with undersize in the support plate, or in other words that with respect to the knife thickness, the upper dimension of the recess is zero, or there is a positive fitting tolerance or positive play. Hence, an especially favorable distribution and embodiment of the pressure per unit of surface area between the tool and the retention is achieved, even if the knife is changed many times.

With a view to the shortest possible down times of the chippers and accurate, secure, non-shifting installation of a new or used knife, it has proved favorable if at least one magnet, preferably a permanent magnet, is disposed in the support plate in the region of contact of the knife, by which magnet the knife is firmly retainable and/or positionable on the support plate when the support plate is removed and installed.

A further object of the invention is attained in a discontinuous edge knife of the type defined at the outset in that the base body is formed as a plane-parallel, strip-like part with a thickness of from 0.5 to 4.0 mm, preferably from 1.0 to 2.4 mm, and has at least one retention recess for bi-axial form fitting and at least one guide recess for mono-axial guidance of the knife on a support plate.

The advantages attained with the knife of the invention reside in particular in the fact that recesses can be made in a simple manner in a strip of preliminary material that is easy to produce with high precision, and based on that, hard cutting edges can be produced with high spacing accuracy. In thermal quenching and drawing as well, in particular of only the beveled blade regions, any distortion that might occur can be counteracted easily by chucked guidance of the knife during grinding, and an exact blade geometry can be assured.

An especially economical embodiment of the knife is attained if a base body has cutting regions on both sides in the longitudinal direction; that the retention recess and the guide recess or recesses are disposed essentially centrally; and that the cutting edges of the cutting regions protruding from both sides are spaced apart by the same distance from the axis connecting the retention recess and the guide recess.

If as is also favorably provided, at least the zones which contain the cutting edges of the knife, formed of tool steel, are quenched and hardened and have a hardness of at least 58 HRC, and preferably at least 61 HRC, good edge holding and a long service life of the blade part are attainable.

The service life of the knife and hence the specific length of usefulness of the chipper can be increased still further if the base body is formed of low-alloy construction or tool steel, and if regional zones of high- speed steel, preferably joined by electron beam or plasma jet welding, which have a hardness of at least 60 HRC, preferably at least 63 HRC and contain the cutting edges, are disposed in the blade regions.

Embodying the knife of soft-center steel in this way has proved to be especially economical, because the inexpensively producible base body of the blade region, which has great toughness and is subject to alternating bending strains at some points, can be made of high-alloy steel with high proportions of hard carbines in a high-strength matrix, which even at relatively high working temperatures and with unclean wood produces maximally long blade life.

For economical removal of desirably high-quality chips with a low proportion of fines, it is favorable if the cutting edges are located in a side face of the knife and are each formed by beveling on one side at an angle of 20° to 40° and in particular 30° to 35°, relative to the side face.

BRIEF DESCRIPTION OF THE DRAWINGS

The above and additional objects, characteristics, and advantages of the present invention will become apparent in the following detailed description of a preferred embodiment, with reference to the accompanying drawings which are presented as non-limiting examples, in which.

DETAILED DESCRIPTION OF THE PREFERRED EMBODIMENTS

Figure 1:
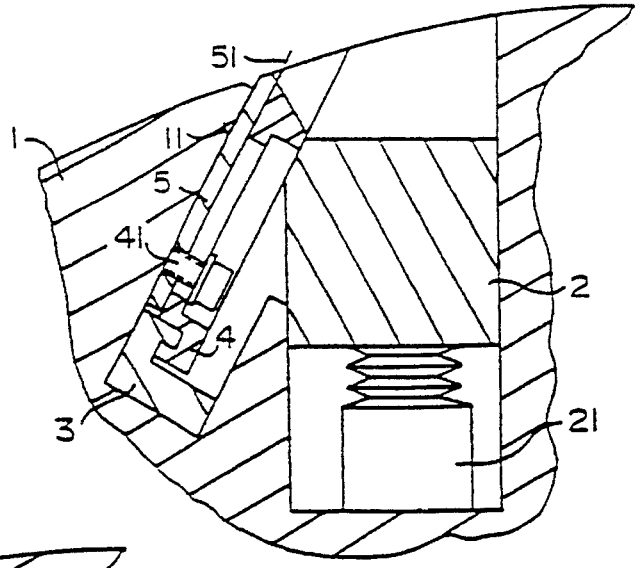
FIG. 1 PRIOR ART
FIG. 1 illustrates, in partial sectional view, a cutter block in accordance with the prior art.

With respect to the drawings, only enough of the construction of the invention has been depicted, to simplify the illustration, as needed for those of ordinary skill in the art to readily understand the underlying principles and concepts of the present invention.

Attention is now directed to the drawings, which include illustrations of merely exemplary embodiments of the present invention. As mentioned above, FIG. 1 illustrates prior art. In the cutter block 1 shown in cross section therein, a conventional blade part 5 is joined by means of a locking screw 41 to a guide part 4 in a recess disposed in the axial direction. Further, this guide part is connected in turn to a retaining strip 3 in a manner secured form-fittingly against a displacement with a radial component. The thick-walled knife 5, in the region opposite the cutting edge 51, has bores with an internal thread for locking screws 41. Upon an adjustment of the cutting edge 51 referred to the surface or axis of the cutter block 1, and in particular after sharpening of the knife, displacement and positioning of the knife of the guide part 4 takes place. The locking screw 41 is first moved loosely in a slit of the guide part 4 and then tightened.

In the arrangement of FIG. 1, the screws 41 must then be tightened in a forcefully self-locking manner for operation, because loosening caused by vibration leads to a loss of the frictional engagement between the guide part 4 and the knife 5, so that the knife is moved outwardly by centrifugal force and can cause damage to the apparatus.

Figure 2:
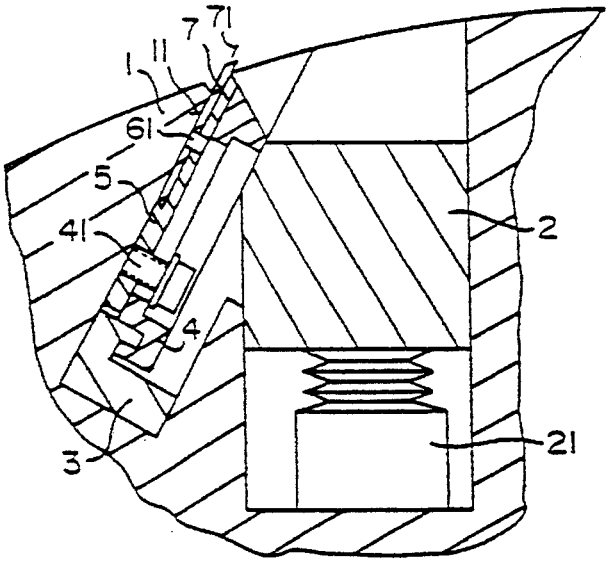
FIGS. 2 and 3 illustrate, also in partial sectional views, cutter blocks according to the invention.
Figure 3:
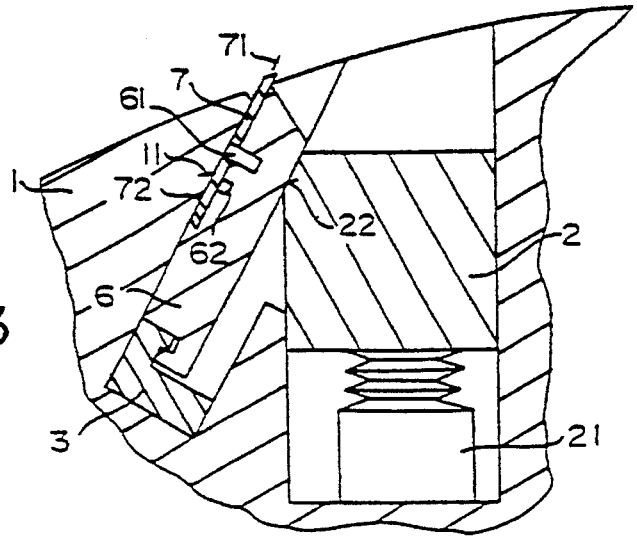

In FIG. 2, a cutter block 1 according to an embodiment according to the invention is shown in cross section. In a recess made in the surface region of the block 1, there is a receiving unit, comprising a guide part 4 and a support plate 6, for a retention of a discontinuous edge knife 7; the parts are joined together by locking screws 41. The joining of the guide part 4 and the support plate 6 may also be done in a non-detachable way or, as shown in FIG. 3, a one-piece support plate 6 shaped with a retaining strip 3 for anchoring purposes may be used. In the contact region of the knife 7, the support plate 6 has positioning pins 61, which cooperate with retention and guide recess 74 and 75, respectively, in the knife 7, to be described below.

If a recess for a multiple or discontinuous edge knife 7 is optionally provided in the support plate 6, then its depth with respect to the knife thickness is embodied with an undersize, for example with a tolerance r6 in accordance with DIN. This means that when the knife 7 is in place, its broad side protrudes slightly beyond the recess. Fixation of the knife 7 is accomplished by an optionally frictionally engaged pressing against the trailing side wall face, in the direction of rotation of the block 1, of the recess in the cutter block 1 by means of the support plate 6, which in turn, optionally with the interposition of a guide part 4, can be subjected to pressure by means of a wedge face 22 of the centrifugal wedge or chuck 2, which can be positioned by means of a pressure or thrust screw 21.

If the knife 7 is turned or replaced, then the centrifugal wedge 2 is pushed back so that the support plate 6 with the discontinuous edge knife 7 can be exposed. Reinstallation of the cutter unit in the cutter block 1 can be done especially easily, fast, accurately and unproblematically if, as schematically shown in FIG. 3, the knife 7 is fixed to the support plate 6 by means of magnets 62, and in particular high-energy permanent magnets. To that end, the magnets are to be installed or removed in such a way that the magnetic flux is closed by the knife 7, in particular by the base body 70 of the discontinuous edge knife.

Figure 4:
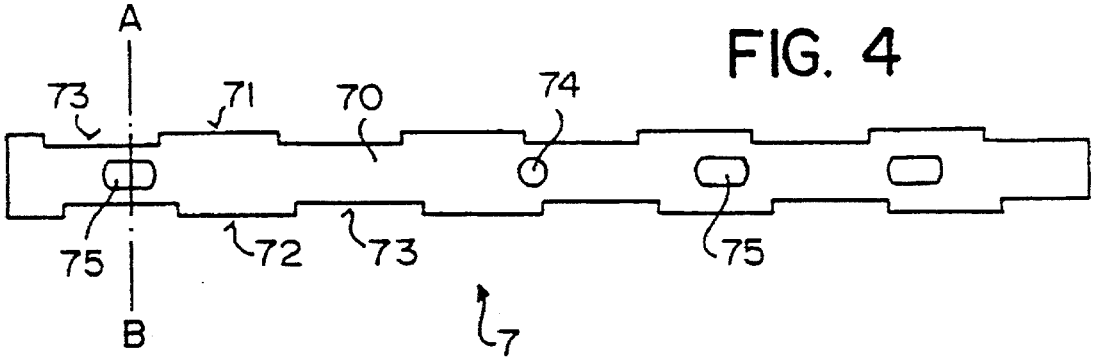
FIG. 4 illustrates, in plan view, a disposable discontinuous edge knife.

An embodiment of a discontinuous edge knife 7 having cutting regions on both sides is shown in FIG. 4. In the base body 70, a retention recess 74 and guide recesses 75 are disposed centrally symmetrically to the blades 71, 72, which are interrupted by intermediate regions with end faces 73. In other words, since the blades 71 and 72 are spaced apart by the same distance from the longitudinal axis of the knife 7, on which the center lines of the recesses are also located, if a cutting edge wears down, a new edge can be furnished by simply turning it, without doing complicated adjustment work. Thus, recess 74 can be considered to be a form fitting recess for bi-axial positioning of the knife and recesses 75 can be considered to be a guide recess for mono-axial positioning of the knife.

Figure 5:
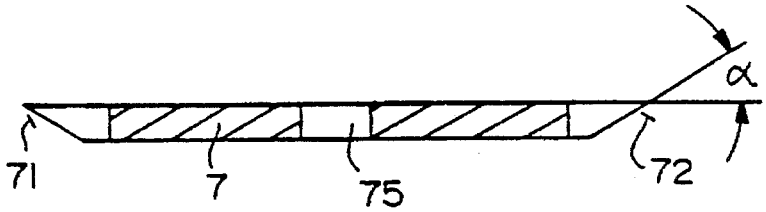
FIG. 5 illustrates, in a transverse cross section taken along line A–B in FIG. 4, a discontinuous edge knife according to the invention with a cutting edge on both sides.

FIG. 5, on a larger scale, shows the cross section of the knife taken along the section line A–B of FIG. 4. The two cutting edges 71, 72 are each prepared by beveling one side of the blade region on the strip-like knife at an angle $\alpha$. This angle is preferably within the range of 20° to 40° and, more preferably, within the range of 30° to 35°.

Figure 6:
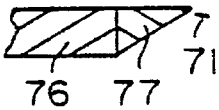
FIG. 6 illustrates a partial transverse cross section through the blade region of a soft-center steel multiple thread knife.

FIG. 6 shows the blade region of a soft-center steel discontinuous edge knife. In the blade region 76, a regional zone 77 of tool steel, in particular high-speed steel, with high edge-holding and high hardness, and in which the cutting edge 71 is also located, is welded onto the strip-like base body 70 of the knife, which is made of steel with high fatigue strength under reversed bending stress. For this welding, electron beam or plasma jet welding has proved to be especially advantageous.

Figure 7:
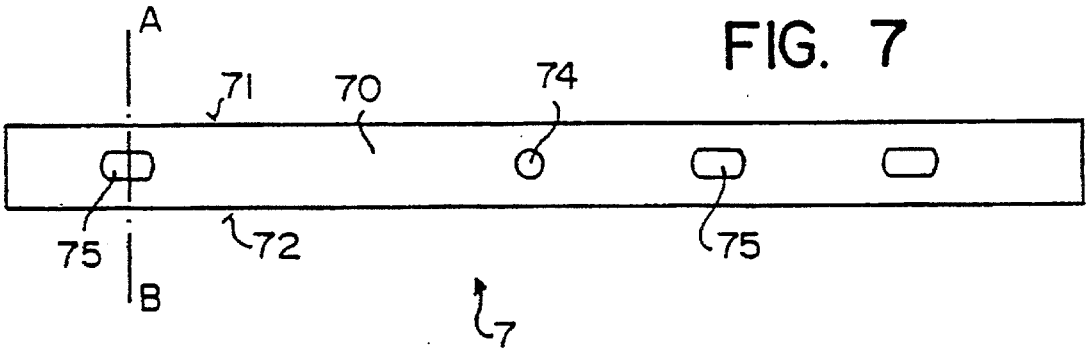
FIG. 7 illustrates, in plan view, a disposable solid blade or continuous edge knife according to the invention.
Figure 8:
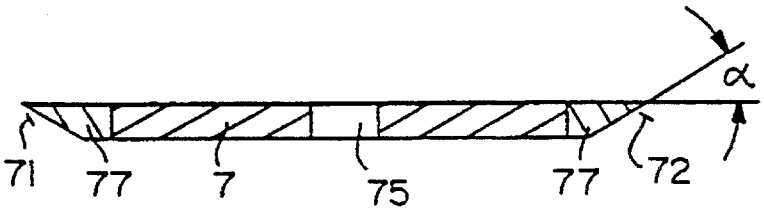
FIG. 8 illustrates, in a transverse cross section taken along line A–B in FIG. 7, a solid blade or continuous edge knife according to the invention.

FIGS. 7 and 8 illustrate an embodiment of the invention whereby the knife has a single solid cutting or sharpened edge on each side, i.e., edges 71 and 72. As with regard to the embodiment of FIGS. 4 and 5, the blades 71 and 72 are spaced apart by the same distance from the longitudinal axis of the knife 7, on which the center lines of the recesses are also located. Accordingly, if cutting edge 71, e.g., wears down, new edge 72 can be furnished by simply turning the knife to expose edge 72 without doing complicated adjustment work.

FIG. 7 illustrates the solid blade in a plan view similar to the plan view of FIG. 4. Further, the knife of FIG. 7 is shown to have a bi-axially operating holding recess 74 and a plurality of mono-axially operating guiding recesses 75 located centrally symmetrically with respect to edges 71 and 72, similar to the above-mentioned plural edge knife embodiment of FIGS. 4 and 5.

FIG. 8 illustrates the embodiment of FIG. 7 on a somewhat enlarged view. The zone 77 with the edges 71, which are bevelled on one side and form a cutting angle $\alpha$ of preferably approximately 30°, or within the aforementioned angle ranges, is made of tool steel, and particularly high-speed steel having a high hardness. These zones 77, made of high-speed steel M2, for example, are connected to the body 70 made of low alloy steel such as AISI No. 4012, by means of electron beam welding or plasma beam welding.

This application is based upon Austrian Application No. A 580/93, filed on Mar. 23, 1993, the priority of which is claimed and the disclosure of which is hereby expressly incorporated by reference thereto in its entirety.

Finally, although the invention has been described with reference of particular means, materials and embodiments, it is to be understood that the invention is not limited to the particulars disclosed and extends to all equivalents within the scope of the claims. Further, it is contemplated that the invention can be practiced in the absence of any element not specifically recited in the claims.

What is claimed:

1. A cutter block for chipping equipment for removing at least one of generally flat and relatively long particles of wood for wood products, said cutter block comprising:

a block body having a surface region, said surface region having at least one recess;

a knife having a cutting edge and a retention portion, said knife being secured in a predetermined position within said recess while having said cutting edge exposed, said retention portion being positioned within said recess, with said knife further including at least one retaining recess and a plurality of guiding recesses;

a retaining arrangement for engagement with said retention portion of said knife for retaining said knife against radial displacement;

a centrifugal member positioned for applying a force to said retention portion of said knife for pressing said retention portion against a side wall of said recess;

a support plate for supporting said knife, said support plate having positioning pins for form-fittingly engaging at least one of said retaining and guiding recesses of said knife in a bi-axial manner, said support plate being connected to said block body and secured against radial displacement, in such a way that said knife is positionable on a trailing side wall face of said recess, with respect to a direction of rotation of said cutter block, said trailing side wall face having at least one rectilinear generatrix, and said knife can be pressed over a large area against said side wall face by the centrifugal member; and a clamping element for positioning said centrifugal member in place.

2. A cutter block as defined by claim 1, wherein:

said knife has a thickness of from 0.5 mm to 4 mm and is located, guided by said positioning pins, preferably in a recess of the support plate that corresponds to the thickness of the knife with an undersize, and the support plate, secured against radial displacement by said retaining means, is in compressive contact, in a cross-sectional region opposite said retaining means, on the one hand with an inclined face of the centrifugal member and, on the other hand, with a side face of said knife, which is supported over a large area by its opposite side face on said side wall of said recess that trails after in the direction of rotation of the cutter block.

3. A cutter block as defined by claim 1, further comprising:

at least one magnet disposed in said support plate in the region of contact of the knife, by which said magnet said knife is firmly positionably retained on said support plate upon removal and installation of said support plate.

4. A cutter block as defined by claim 3, wherein:

said at least one magnet comprises a permanent magnet.

5. A cutter block as defined by claim 1, wherein:

said recess in said block body comprises at least one longitudinally extending straight recess in the surface region.

6. A cutter block as defined by claim 1, said recess in said block body comprises at least one longitudinally extending helically-shaped recess in the surface region.

7. A cutter block as defined by claim 1, wherein:

said knife comprises a disposable knife having, on each of two opposite sides, a discontinuous multiple edge, insertable into said recess with either of said sides.

8. A cutter block as defined by claim 1, wherein:

said knife comprises a disposable knife having, on each of two opposite sides, a solid blade, insertable into said recess with either of said sides.

9. A cutter block as defined by claim 1, wherein:

said support plate is unitarily formed with a guiding part, said block body having means for releasably coupling said guiding part against radial displacement.

10. A cutter block as defined by claim 1, further comprising:

a guiding part connected to said support plate, said block body having means for releasably coupling said guiding part against radial displacement.

11. A cutter block as defined by claim 1, wherein:

said knife has a thickness of from 0.5 mm to 4 mm.

12. A cutter block as defined by claim 1, wherein: said knife has a thickness of from 1.0 to 2.5 mm.

13. A cutter block as defined by claim 1, wherein: said positioning pins form fittingly engage said retaining recess of said knife for bi-axial positioning of said knife.

14. A cutter block as defined by claim 1, wherein: said positioning pins form fittingly engage said guide recesses of said knife for mono-axial positioning of said knife.

15. A multiple edge knife for cutter spindle chippers for removing at least one of generally flat and relatively long particles of wood for producing wood products including excelsior and particle board, said knife comprising:

a base body having a cutting edge, said base body having a pair of laterally opposite parallel planar sides, forming a strip-like part with a predetermined thickness, said thickness being from 0.5 millimeters to 4.0 millimeters, said base body further having at least one retention recess, for bi-axial form fitting of the knife in a cutter block, and at least one guide recess, for mono-axial guidance of said knife on a support plate.

16. A multiple edge knife as defined by claim 15, wherein:

said cutting edge comprises a plurality of intermediate regions with end faces free in a longitudinal direction, cutting regions protruding laterally from said end faces having respective cutting edge portions.

17. A multiple edge knife as defined by claim 16, wherein:

said cutting edge is one of a pair of oppositely disposed cutting edges;

said retention recess and each of said guide recesses are disposed substantially centrally between said oppositely disposed cutting edges;

said cutting edge portions of said cutting regions protruding from both sides are spaced apart by the same distance from an axis connecting said retention recess and said guide recesses.

18. A multiple edge knife as defined by claim 15, wherein:

at least zones which contain said cutting edges are formed of tool steel, are quenched and hardened and have a hardness of at least 58 HRC.

19. A multiple edge knife as defined by claim 18, wherein:

said zones which contain said cutting edges have a hardness of at least 61 HRC.

20. A multiple edge knife as defined by claim 15, wherein:

said base body is formed of low-alloy construction or tool steel and regional zones containing said cutting edges are formed of high-speed steel having a hardness of at least 60 HRC.

21. A multiple edge knife as defined by claim 20, wherein:

said regional zones are connected to said base body by a weld, performed by electron beam or plasma jet welding.

22. A multiple edge knife as defined by claim 20, wherein:

said regional zones have a hardness of at least 63 HRC.

23. A multiple edge knife as defined by claim 15, wherein:

said cutting edges are located in a side face of said knife and are each formed by a bevel on one side at an angle of between 20° to 40° relative to the side face.

24. A multiple edge knife as defined by claim 20, wherein:

said angle is between 30° and 35°.

25. A multiple edge knife as defined by claim 15, wherein:

said cutting edge comprises a solid blade.

26. A multiple edge knife as defined by claim 15, wherein:

said strip-like part has a thickness between 1.0 millimeters and 2.4 millimeters.

* * * * *